US011365533B2

(12) United States Patent
Jensen

(10) Patent No.: US 11,365,533 B2
(45) Date of Patent: Jun. 21, 2022

(54) SIPHON VALVE

(71) Applicant: AS America, Inc., Piscataway, NJ (US)

(72) Inventor: Robert Jensen, East Brunswick, NJ (US)

(73) Assignee: AS America, Inc., Piscataway, NJ (US)

( * ) Notice: Subject to any disclaimer, the term of this patent is extended or adjusted under 35 U.S.C. 154(b) by 6 days.

(21) Appl. No.: 16/633,272

(22) PCT Filed: Jun. 19, 2019

(86) PCT No.: PCT/US2019/037884
§ 371 (c)(1),
(2) Date: Jan. 23, 2020

(87) PCT Pub. No.: WO2020/005660
PCT Pub. Date: Jan. 2, 2020

(65) Prior Publication Data

US 2021/0115651 A1 Apr. 22, 2021

Related U.S. Application Data

(60) Provisional application No. 62/691,293, filed on Jun. 28, 2018.

(51) Int. Cl.

| | |
|---|---|
| ***E03D 1/08*** | (2006.01) |
| ***E03D 1/012*** | (2006.01) |
| *E03D 1/32* | (2006.01) |

(52) U.S. Cl.
CPC ..... *E03D 1/087* (2013.01); *E03D 1/012* (2013.01); *E03D 1/32* (2013.01); *E03D 2201/30* (2013.01); *E03D 2201/40* (2013.01)

(58) Field of Classification Search
CPC ..... E03D 1/08–087; E03D 1/10–125; E03D 1/165; E03D 1/183; E03D 11/18; E03D 2201/30
See application file for complete search history.

(56) References Cited

U.S. PATENT DOCUMENTS 384,978 A * 6/1888 Howe ..... E03D 1/165 137/135
1,302,820 A * 5/1919 McCaffrey ..... E03D 1/087 4/374

(Continued)

FOREIGN PATENT DOCUMENTS

DE 643139 * 4/1937 ..... E03D 1/087
GB 464588 * 4/1937 ..... E03D 1/165

OTHER PUBLICATIONS

International Search Report dated Aug. 22, 2019 in corresponding International Application No. PCT/US2019/037884 (2 pages).

*Primary Examiner* — David P Angwin
*Assistant Examiner* — Nicholas A Ros
(74) *Attorney, Agent, or Firm* — Tyler A. Stevenson; Anna-Lisa L. Gallo

(57) ABSTRACT

A siphon valve assembly, the assembly comprising a tubular core; a head coupled to and surrounding a top of the core; and a fluid spray initiator coupled to the head; wherein a lower end of the head defines a siphon valve inlet, a lower end of the tubular core defines a siphon valve outlet, an upper end of the tubular core comprises a weir, and the spray initiator is configured to discharge a fluid into the core to induce a siphon flow of a surrounding fluid through the siphon valve inlet, over the weir, and out the siphon valve outlet.

20 Claims, 6 Drawing Sheets

(56) References Cited

U.S. PATENT DOCUMENTS

| | | | | | |
|---|---|---|---|---|---|
| 1,563,948 | A | * | 12/1925 | Azone | E03D 1/087<br>4/374 |
| 1,812,774 | A | * | 6/1931 | Collison | E03D 1/183<br>137/410 |
| 2,068,252 | A | * | 1/1937 | Weber | E03D 1/087<br>4/374 |
| 2,239,570 | A | * | 4/1941 | Pribula | E03D 1/165<br>4/303 |
| 2,612,407 | A | * | 9/1952 | Bete | B05B 1/262<br>239/501 |
| 3,072,346 | A | * | 1/1963 | Wahlin | B65D 83/28<br>239/487 |
| 3,082,433 | A | * | 3/1963 | Armstrong | E03D 1/165<br>4/333 |
| 3,146,674 | A | * | 9/1964 | Wahlin | B05B 1/3415<br>409/132 |
| 3,224,013 | A | * | 12/1965 | Tubbs | E03D 11/08<br>4/425 |
| 3,244,013 | A | * | 4/1966 | Deschner | F15B 15/10<br>74/18.2 |
| 4,114,208 | A | | 9/1978 | Imler | |
| 5,113,536 | A | * | 5/1992 | Osmond | E03D 1/08<br>137/142 |
| 5,803,114 | A | | 9/1998 | Johnson | |
| 6,823,535 | B2 | | 11/2004 | Tomita | |
| 7,000,627 | B1 | * | 2/2006 | Johnson | E03D 1/00<br>137/1 |

* cited by examiner

SIPHON VALVE

The present invention generally relates to a flush valve for a water closet system, for example, a water closet tank for tank-type toilets. Specifically, the present invention relates to a siphon flush valve including a spray initiator positioned to initiate a siphon, a flapperless flush system and a method of initiating siphon function.

BACKGROUND

Tank-type toilets are widely used residentially and commercially. Tank-type toilets may comprise flush systems having a water fill valve and a flush valve with a flapper to regulate water to a toilet bowl. A flapper type flush valve has a flapper seal below a water line that may be prone to leaking due to wear and/or exposure to chemicals. Toilet flappers may be a leading cause of leaking or running toilets. There is a need for improved flush valve technology. More particularly, there is a need for a reliable flapperless valve for use in a water closest tank for a tank-type toilet to optimize functionality and/or to avoid leakage.

SUMMARY

According to an embodiment, a siphon flush valve for a toilet may include a core configured to couple to a toilet tank opening; a head coupled to a top of the core, the head having a head opening; an initiator coupled to the head opening; a siphon flush valve inlet; and a siphon flush valve outlet. An initiator may be configured to induce a siphon flow of a surrounding fluid, through the siphon flush valve inlet, and exiting through the siphon flush valve outlet. In some embodiments, a surrounding fluid may be in a toilet tank, wherein a starting (standing) water level will be above a siphon valve inlet defined by a lower end of the head.

A head may be a substantially cylindrical cap located around (about) the core. In some embodiments, the head may be a substantially cylindrical cap located substantially concentrically around the core. A head opening may be located in a center of the substantially cylindrical cap and wherein the initiator extends downward from the opening into the core.

In some embodiments, the core may include weir located at an upper surface or edge of the core. In some embodiments, a core may be substantially tubular. A core may comprise a substantially hollow cylinder-like tube having open top and bottom ends. "Tubular" may mean tube-like (shaped like a tube). In some embodiments, a core may include a first substantially tubular section, a tapered section, and a second substantially tubular section. In some embodiments, an upper portion of a tubular core curves outward at the weir and extends longitudinally downward from the weir. In some embodiments, an upper section curves outward at the weir and extends longitudinally downward parallel to an outer surface of the tubular core.

A siphon flush valve may include a flow path defined between an inner surface of the head and an outer surface of the core. In some embodiments, the initiator may include a bore having a substantially constant diameter. In some embodiments, the initiator may comprise a tapered bore. In some embodiments, the initiator may have a bore tapered outwardly (downward) in a cone shape. A tapered bore may be configured to provide a shaped fluid spray. A siphon flush valve inlet may be located at a lower end of the head and the siphon flush valve outlet is located at a lower end of the core. A siphon flush valve may include an internal cavity, wherein the siphon flush valve inlet is configured such that the internal cavity has a first pressure when at a tank starting water level and a second pressure when at a tank ending water level.

In some embodiments, a surrounding fluid may have a starting level at a point above the siphon flush valve inlet and an ending level at a point at or below the siphon flush valve inlet. The terms "starting" and "ending" meaning prior to and at the end of a siphon flush. A siphon flush may end when a fluid level reaches the flush valve inlet and air enters the valve, breaking the siphon. A surrounding fluid surrounds the siphon flush valve, for instance as in a toilet tank.

An initiator may be a spray initiator. A spray initiator may be a pressurized spray initiator. A siphon flush valve inlet may be positioned with a first configuration below a tank starting water level and a second configuration above a tank ending water level. A head and the core may be longitudinally axially aligned.

A siphon flush valve may be flapperless. A siphon flush valve inlet may be located circumferentially around the core. A head may be a dome and wherein the dome is wider than the core to define the siphon flush valve inlet. An initiator may be configured to discharge a pressurized fluid to the core in a cone-shaped spray.

An initiator may be configured to create a pressure differential between a bore of the core (the core bore) and a toilet tank. A head may be located around the core such that the siphon flush valve inlet and a flow path are formed between the head and the core. In some embodiments, the head may be located substantially concentrically around the core. A siphon flush valve may be configured without moving parts.

According to an embodiment, a siphonic flush valve system for a toilet may include a siphon flush valve, the siphon flush valve having: a core coupled to a toilet tank opening, a head having a head opening and attached at a top of the core, and an initiator coupled to the head opening, a siphon flush valve fluid supply line coupled to the initiator; a fluid supply valve coupled to the siphon flush valve fluid supply line; and an actuator configured to open the fluid supply valve to initiate a flow of pressurized fluid in the siphon flush valve fluid supply line. An initiator may be configured to supply the flow of pressurized fluid to the core to initiate a siphon flow of a surrounding fluid in a toilet tank, through the siphon flush valve, and into a toilet bowl.

An initiator may be configured to discharge flow of pressurized fluid to the core in a cone-shaped spray. An initiator may be configured to create a pressure differential between a bore of the core and the toilet tank. A siphonic flush valve system may include a flow path from a siphon flush valve inlet and a siphon flush valve outlet and wherein the siphon flow flows through the flow path. A flow path may extend from the siphon flush valve inlet, through a space between the core and the head, over a weir on the core, though a bore of the core, and to the siphon flush valve outlet.

A head may be located around the core such that a siphon flush valve inlet and a flow path are formed between the head and the core. A core may include a weir and a down leg portion and wherein the initiator extends into the down leg portion. A siphon flush valve may be configured to empty fluid in the toilet tank from a starting water level adjacent the weir to an ending water level adjacent a siphon flush valve inlet.

In some embodiments, an actuator may be an electronic actuator in electronic communication with a fluid supply valve and configured to open and close the fluid supply valve. Electronic communication may be wired or wireless. An actuator may be a toggle switch, a button, a lever, a knob, a handle, etc. In other embodiments, an actuator may be hydraulic, pneumatic, mechanical, or hydro-mechanical. In some embodiments, an electronic actuator may be associated with a battery and/or another power source.

In some embodiments, a fluid supply valve may be configured to be actuated manually and/or automatically.

In some embodiments, a fluid supply valve may be associated with a sensor, for instance a presence sensor such as an infrared (IR) sensor. In some embodiments, a solenoid valve may be in electrical communication with a controller (microcontroller or printed circuit board) in electrical communication with a sensor. A controller/sensor assembly may be configured to actuate a solenoid valve upon detecting an event, for example detecting an exit of a user. In some embodiments, associated sensors may include one or more of IR sensors, proximity sensors, pressure sensors, photoelectric sensors, optical sensors, motion sensors, ultrasonic sensors, microwave sensors, capacitive sensors or resistive-touch type sensors.

In certain embodiments, a fluid supply valve may be configured to close after a certain amount of time has elapsed after being opened. In some embodiments, a manual actuation system may be configured to close a supply valve after a certain period of time. A period of time may extend beyond a "siphon break" to provide fluid to refill a toilet bowl to provide a bowl seal. In some embodiments, a fluid supply valve may be associated with a timer or clock. In some embodiments a controller associated with a fluid supply valve may comprise a timer function and configured to open a supply valve and to close the supply valve after a certain amount of time has elapsed.

A siphon flush valve may be flapperless. A siphon flush valve may have no moving parts. A fluid supply valve (supply valve) may be a solenoid valve. An actuator may be configured to close a fluid supply valve to terminate flow of pressurized fluid in the siphon flush valve fluid supply line.

According to an embodiment, a method for siphonic flow through a siphon flush valve in a toilet may include supplying a pressurized fluid to an initiator in a siphon flush valve; discharging the pressurized fluid into the siphon flush valve to create a pressure differential inside the siphon flush valve; initiating a siphon flow of a fluid in a toilet tank; flowing fluid in the toilet tank from a siphon flush valve inlet to a siphon flush valve outlet; and terminating the siphon flow of fluid from the toilet tank when an ending fluid level in the toilet tank is reached.

A method comprising supplying the pressurized fluid to the initiator may comprise opening a solenoid valve via an actuator to initiate a flow of the pressurized fluid through a siphon flush valve fluid supply line.

A method may include discharging the pressurized fluid into the siphon flush valve comprises discharging the pressurized fluid in a full cone-shaped spray, hollow cone-shaped spray, or square cone-shaped spray.

A method may include initiating the siphon flow of fluid in the toilet tank comprises causing fluid in the toilet tank to rise up to the siphon flush valve inlet, spill over a weir in the siphon flush valve, and flow through a down leg portion of the siphon flush valve to the siphon flush valve outlet. A method may include terminating the siphon flow comprises introducing air into the siphon flow. A method may include terminating the pressurized fluid through the initiator at a predetermined time after the siphon flow is initiated. A method may include discharging fluid in the toilet tank from the siphon flush valve outlet to a toilet bowl. A method may include a starting fluid level at a height of a weir in the siphon flush valve and an ending fluid level at a height of the siphon flush valve inlet.

According to an embodiment, a siphonic flush valve may include a flush valve body; a flush valve bore within the flush valve body; and a spray initiator in fluid communication with the flush valve bore. A spray initiator may be configured to discharge a pressurized fluid in contact with an entire perimeter of the flush valve bore to create a fluid seal within the flush valve bore thus initiating a siphon flow within the flush valve.

A spray initiator may be configured to create a negative pressure differential in the flush valve bore to initiate the siphon flow. A spray initiator may be configured to discharge the pressurized fluid in a full cone-shaped spray, hollow cone-shaped spray, or square cone-shaped spray, among other shapes.

According to an embodiment, a method for initiating fluid flow in a flush valve of a toilet may include discharging a pressurized fluid from a spray initiator in a flush valve; contacting an entire perimeter of a bore of the flush valve with the pressurized fluid; creating a fluid seal within the bore; creating a negative pressure differential in the bore; initiating a siphon flow in the flush valve; and discharging fluid from a toilet tank to a toilet bowl with the siphon flow.

BRIEF DESCRIPTION OF DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

As will now be described in detail with reference to the figures, the present invention is directed to a siphon flush valve, system and method for a toilet. A siphon flush valve is preferably flapperless. A flush valve system may be configured to provide for initiation and termination of a siphon flow for flushing. A siphon flow may be initiated by a spray initiator causing a pressure differential within the valve.

A flush valve generally includes a core, a head and a spray initiator. A head and core may be concentric and a spray initiator may be positioned at the top of a siphon flush valve. In use, a flush valve may be positioned in a tank with a starting tank water level sufficient to reach the top of the head. To initiate operation of a flush valve, pressurized water initiates a spray into the core creating a pressure differential within the core causing the tank water to rise up in the head and spill over the valve weir into the core. This establishes a siphon flow of water for discharge into the toilet bowl for cleaning the bowl and removing waste. Once full siphon flow is established through the valve, the pressurized water may be turned off. As the tank water discharges, the tank water level goes down to an ending water level generally at the bottom of the head thereby allowing air to enter into the head and a siphon flow is stopped. A fill valve may be provided and configured to refill the toilet tank to allow subsequent repeat flush cycles. Details of various exemplary implementations of a siphon flush valve are discussed below with reference to the figures.

Figure 1A:
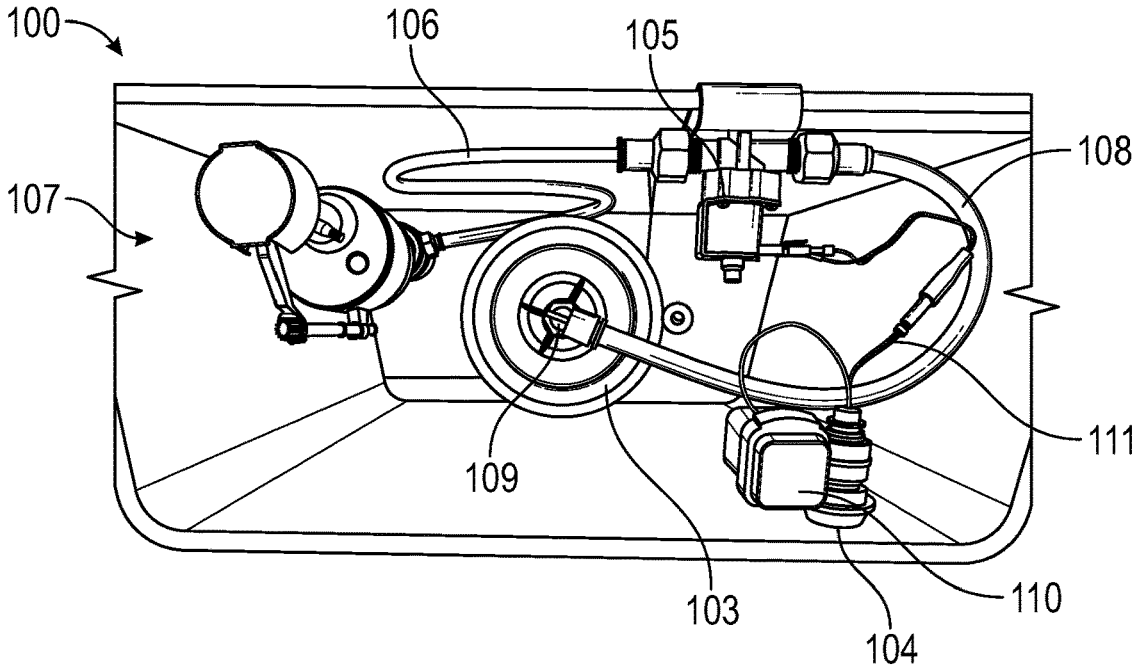
FIG. 1A and FIG. 1B depict a toilet tank assembly comprising a siphon valve assembly, according to an embodiment.
Figure 1B:
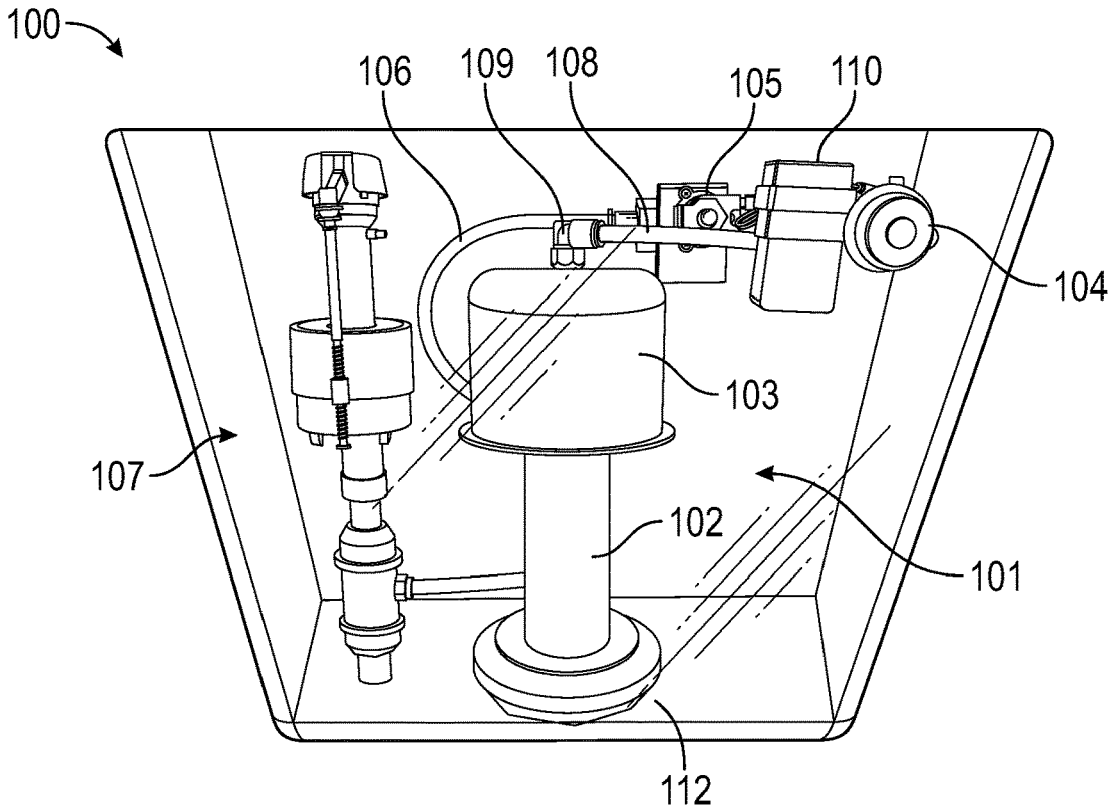

FIG. 1A and FIG. 1B depict a toilet tank assembly 100 in a top view and front view, respectively, according to one embodiment. Shown are siphon valve assembly 101 comprising tubular core 102 and head 103. In this embodiment, siphon valve assembly 101 is configured to be automatically electrically initiated via presence sensor 104. Upon detection of presence and subsequent absence of a user, sensor 104 will signal solenoid valve 105 to open, causing fluid flow from first pressure line 106 coupled to fill valve 107, through second pressure line 108 to a spray initiator (not visible) coupled to spray fitting 109 in head 103 and into tubular core 102 to initiate a siphon. Upon initiation of a siphon, flush water will exit core 102 through outlet 112 to a bowl (not shown). Sensor 104 is in electronic communication with one or more batteries in battery housing 110 and electrical wires 111.

Figure 2A:
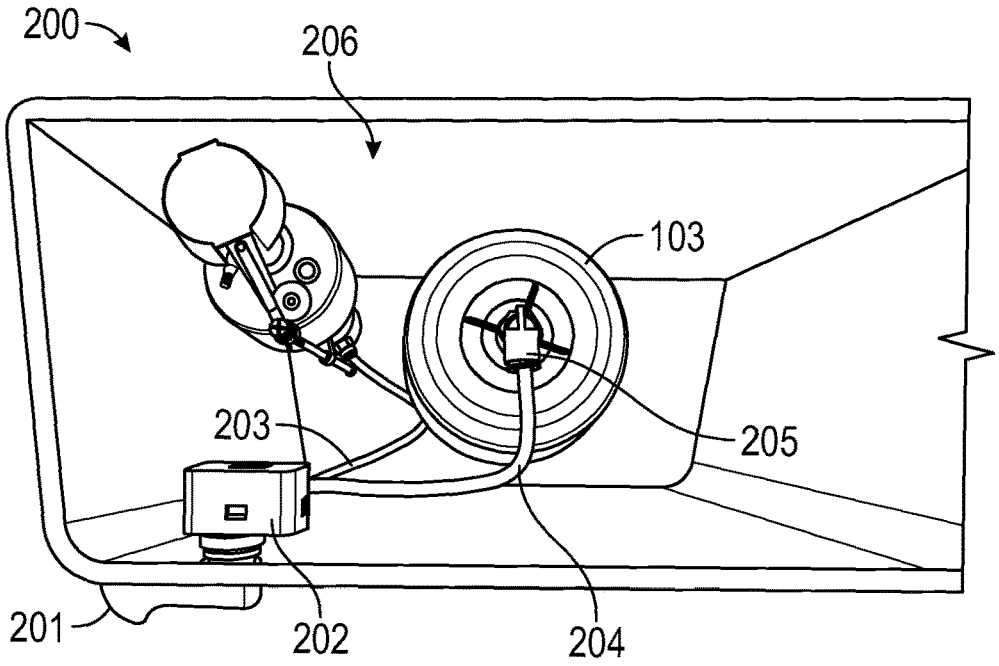
FIG. 2A and FIG. 2B depict a toilet tank assembly comprising a siphon valve assembly, according to an embodiment.
Figure 2B:
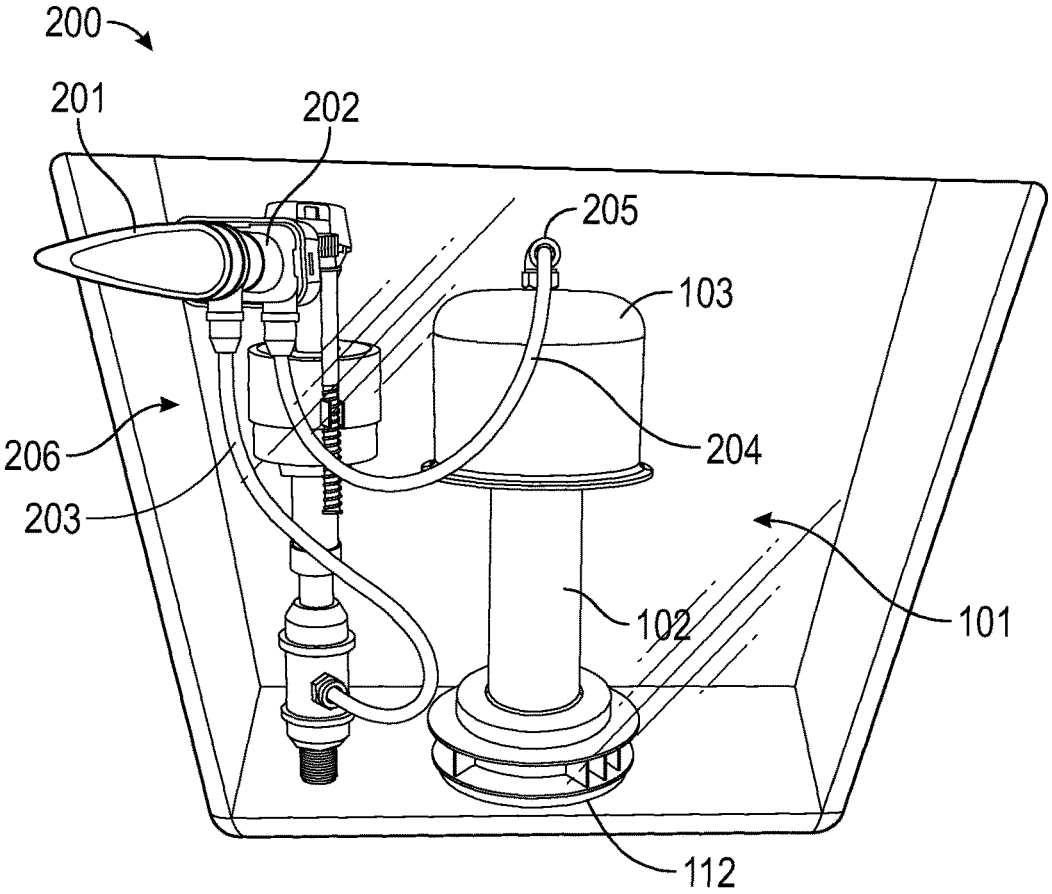

FIG. 2A and FIG. 2B show a toilet tank assembly 200 in a top view and front view, respectively, according to one embodiment. Shown are siphon valve assembly 101 comprising tubular core 102 and head 103. In this embodiment, siphon valve assembly 101 is configured to be manually initiated via manual flush handle 201. Handle 201 is configured to actuate activation valve 202. Upon actuation of valve 202, pressurized water will flow through first pressure line 203, and through second pressure line 204 to a spray initiator (not visible) coupled to spray fitting 205 in head 103 and into tubular core 102 to initiate a siphon. First pressure line 203 is coupled to fill valve 206 and activation valve 202. Upon initiation of a siphon, flush water will exit core 102 through outlet 112 to a bowl (not shown). A fluid pressure line (fluid supply line) may be coupled to a flush valve via an inlet valve as shown, or independently from a fluid source.

Figure 3:
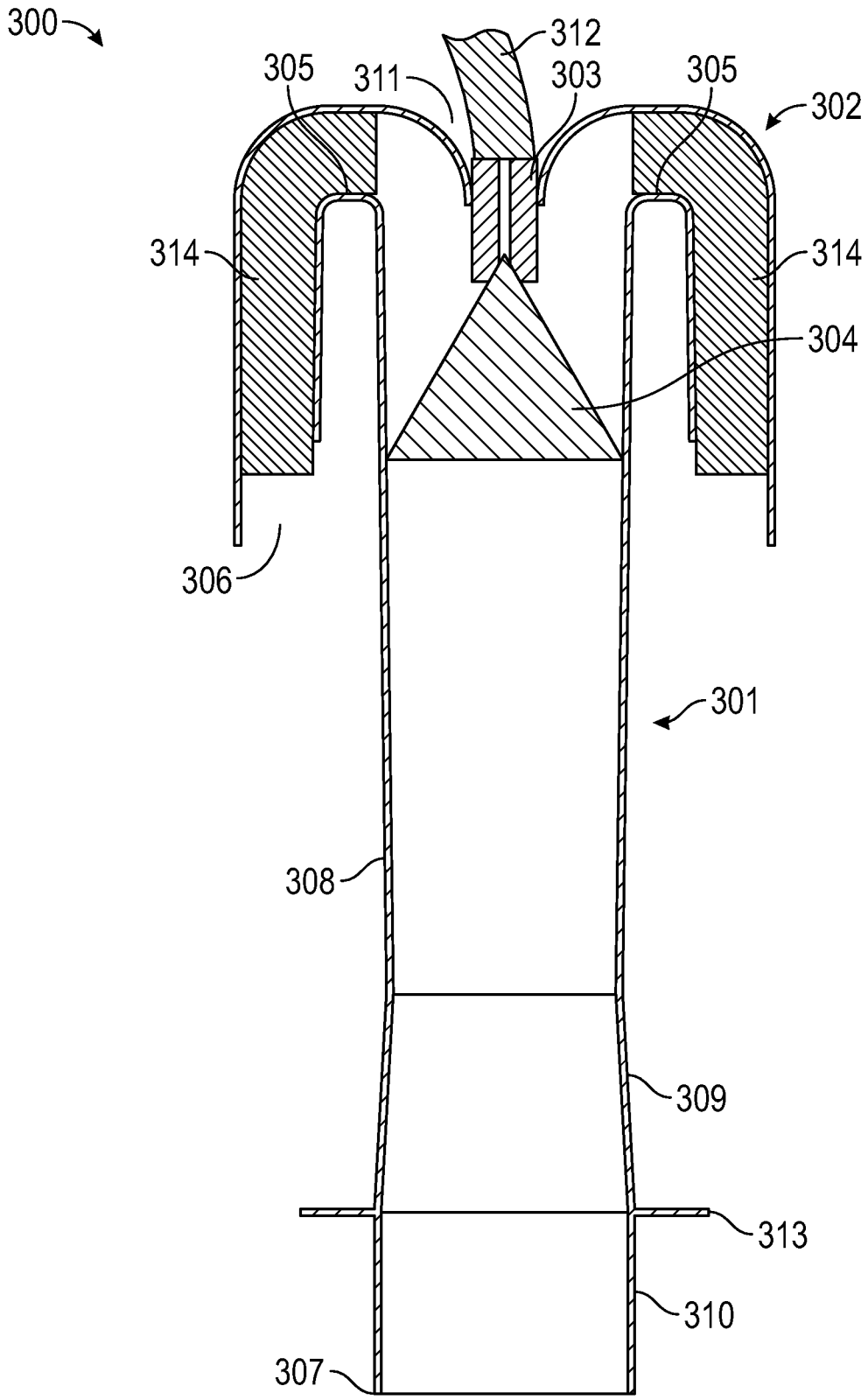
FIG. 3 shows a siphon flush valve in cross-section, according to an embodiment, including showing spray from a fluid supply line and a spray initiator.

FIG. 3 depicts a cutaway view of a flush valve assembly 300 according to an embodiment. Assembly 300 comprises tubular core 301 and head 302. Disposed in head 302 is spray initiator 303. Initiator 303 may have a substantially constant diameter portion and an outwardly tapered portion. The outwardly tapered portion may be substantially cone-shaped and configured for water to discharge from initiator 303 in a substantially cone shape 304 into core 301 and onto the interior wall of core 301. An outwardly tapered portion may have an angle of spray between about 50 degrees and about 120 degrees. A surrounding fluid of a toilet tank may have a level between weir 305 and flush valve inlet 306. Upon initiation of a siphon, surrounding fluid will enter inlet 306, pass over weir 305, through tubular core 301 and to a bowl (not shown) via outlet 307 to initiate a flush. As a surrounding fluid level drops, the siphon will break when air enters inlet 306 and a flush will stop. In this embodiment, core 301 comprises a first substantially tubular section 308, a tapered section 309, and a second substantially tubular section 310, and wherein an upper portion of the first substantially tubular section curves outward at the weir and extends longitudinally downward from the weir. In this manner, head 302 and an upper portion of core 301 may be substantially concentric. Head 302 may comprise a concave section 311 surrounding initiator 303 and fluid supply line 312. A core may include a flange 313 extending outwardly from an outer surface of a tubular core and align a siphon flush valve with a tank opening and maintain a siphon flush valve therein. The cutaway view of assembly 300 shows splines 314 disposed in head 302. Splines are further described in FIG. 4.

Figure 4:
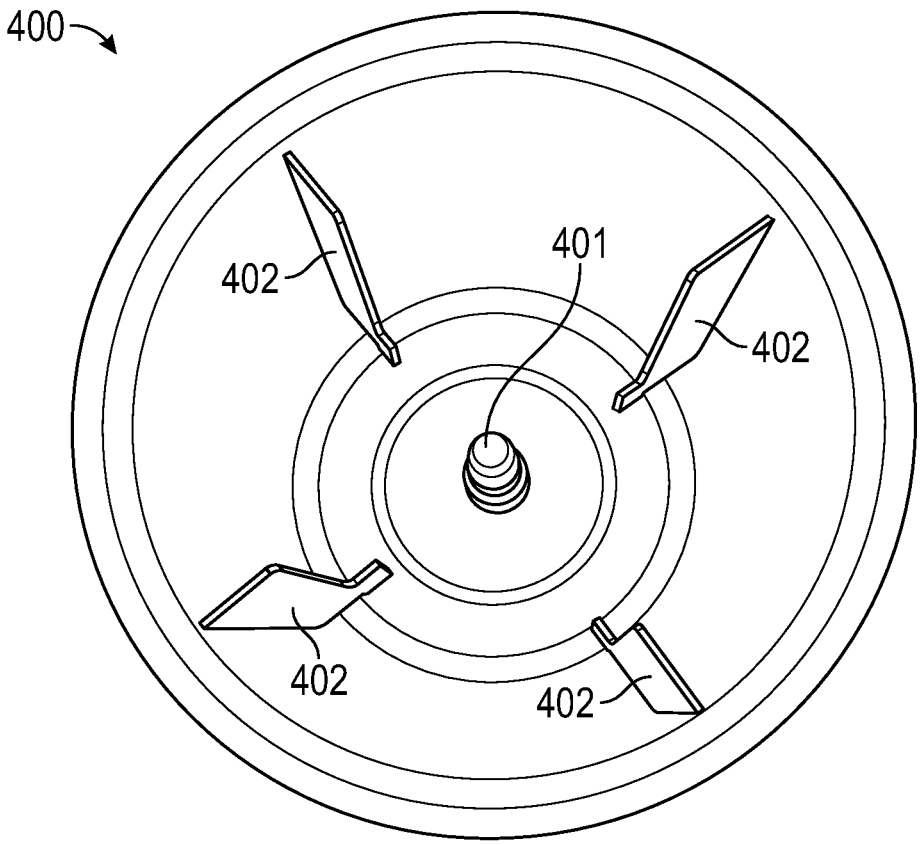
FIG. 4 shows an underside of a siphon valve head, according to an embodiment.
Figure 5A:
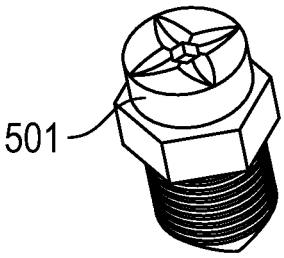
FIG. 5A, FIG. 5B, FIG. 5C, and FIG. 5D show a spray initiator of a siphon flush valve, according to certain embodiments.
Figure 5B:
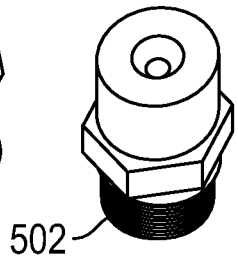
Figure 5C:
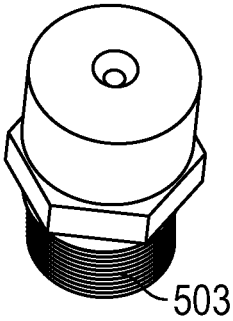
Figure 5D:
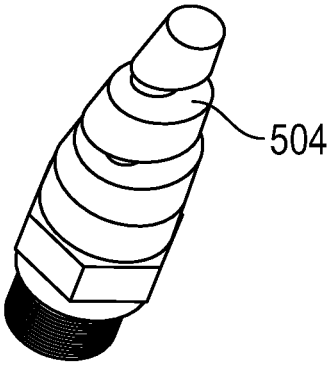

FIG. 4 shows a siphon valve head 400 from an underside, according to an embodiment. Head 400 comprises a dome or cap shape. An opening in head 400 is fitted with spray fitting 401 which will couple to a spray initiator (not shown). Head 400, as shown, may have a plurality of splines 402 extending from an inner surface of head 400. Although four splines 402 are depicted, more or fewer splines 402 may be provided. Splines 402 may locate and hold head 400 in place on an upper portion of a tubular core. Splines 402 may rest on upper portion of a tubular core. Alternatively, splines 402 may provide a friction fit with an upper portion of a tubular core. Alternatively, splines 402 may be secured with other connection types (e.g. adhesion or fastening) to a tubular core. Splines 402 may be generally L-shaped. Splines 402 may extend from a top inner surface and inner wall surface. Splines 402 may be coupled to a top inner surface and inner wall surface of head 400. Splines 402 may be molded or formed with head 400. Alternatively, splines 402 may be formed separately and coupled to head 400, for example, by gluing or fastening. Splines 402 may be full length, extending along the entire length of head 400 or splines 402 may be partial length, extending along a portion of the length of head 400. Splines 402 may centrally located head 400 on a tubular core. Splines 402 may extend to top of head 400 and may aid in determining a vertical position. Splines 402 may create a radially and vertically extending space (a flow path) between upper portion of a core and an inner surface of head 400. A radially and vertically extending space may be an annular space. An annular space between upper portion of a core and an inner surface of head 400 may be configured for water to flow into a siphon flush valve, through an inlet, over a weir, and into a bore of a tubular core. A configuration of splines 402 may vary depending upon the desire annular space and flow path.

Figure 6A:
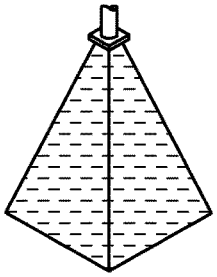
FIG. 6A, FIG. 6B, and FIG. 6C show spray patterns of spray initiators, according to some embodiments.
Figure 6B:
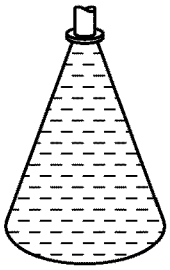
Figure 6C:
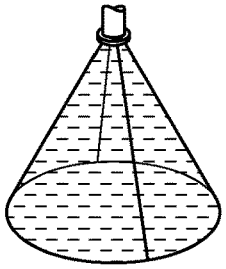

FIG. 5A, FIG. 5B, FIG. 5C and FIG. 5D, show spray initiators 501, 502, 503, and 504, according to certain embodiments. Spray initiators 501, 502, 503, and 504 comprise a central bore. Spray initiator 504 is a "pigtail" initiator. A bore may comprise a shape that provides a certain shaped fluid spray, for instance a substantially square or pyramid-shaped spray, such as depicted in FIG. 6A, and provided by spray initiator 501. Initiator 502 may have a bore shape that provides a substantially cone-shaped spray, such as a solid cone-shaped spray as depicted in FIG. 6B. Initiator 503 may also have a bore shape that provides solid a cone-shaped spray as depicted in FIG. 6B. Initiator 504 may have a bore shape that provides a hollow cone-shaped spray, as depicted in FIG. 6C. A spray pattern of initiators 501, 502, 503, and 504 may make a full perimeter contact with a bore of a tubular core. Full perimeter contact may provide a water seal within a siphon flush valve and assist in initiating a siphon effect and a flush.

Figure 7:
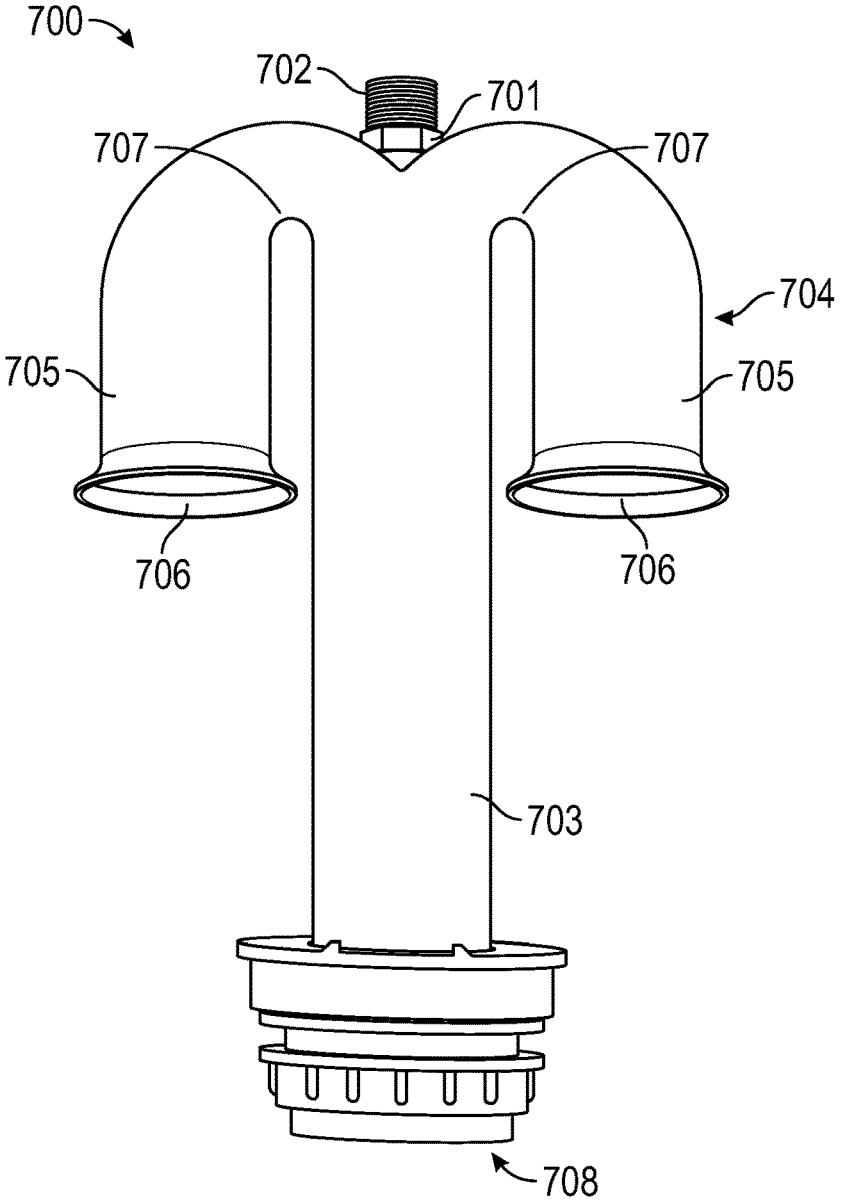
FIG. 7 displays a flush valve assembly, according to an embodiment.

FIG. 7 depicts a non-concentric siphon flush valve 700, according to an embodiment. Siphon flush valve 700 contains an initiator 701 having a supply connection 702 located at a top of a core 703. Initiator 701 may be the same or similar as any of the initiators previously described. Core 703 may be the same or similar as any cores previously described. Core 703 may have a varied diameter bore. Core 703 may have a diverging bore. In siphon flush valve 700, head 704 may take a form of two inlet pipes 705 arranged symmetrically about core 703. Each inlet pipe 705 may have a flared inlet 706. Flared inlets 706 may allow increased and improved flow into siphon flush valve 700. Each inlet pipe 705 may comprise a weir 707. Siphon flush valve 700 may operate in the same or similar manner as the previously described siphon valves with the exception that fluid flow enters siphon flush valve 700 through flared inlets 706. Surrounding tank fluid may flow from flared inlets 706, over weirs 707, through bore of core 703 and out a siphon flush valve outlet 708. Tank fluid may flow through flared inlets 706 simultaneously or substantially simultaneously. Tank fluid may flow uniformly through both inlet pipes 705. In other embodiments, a head may comprise a plurality of inlets or inlet pipes, for example, 2, 3, 4, 5, 6, 7, 8, or more inlet pipes.

Figures 8A, 8B, 8C:
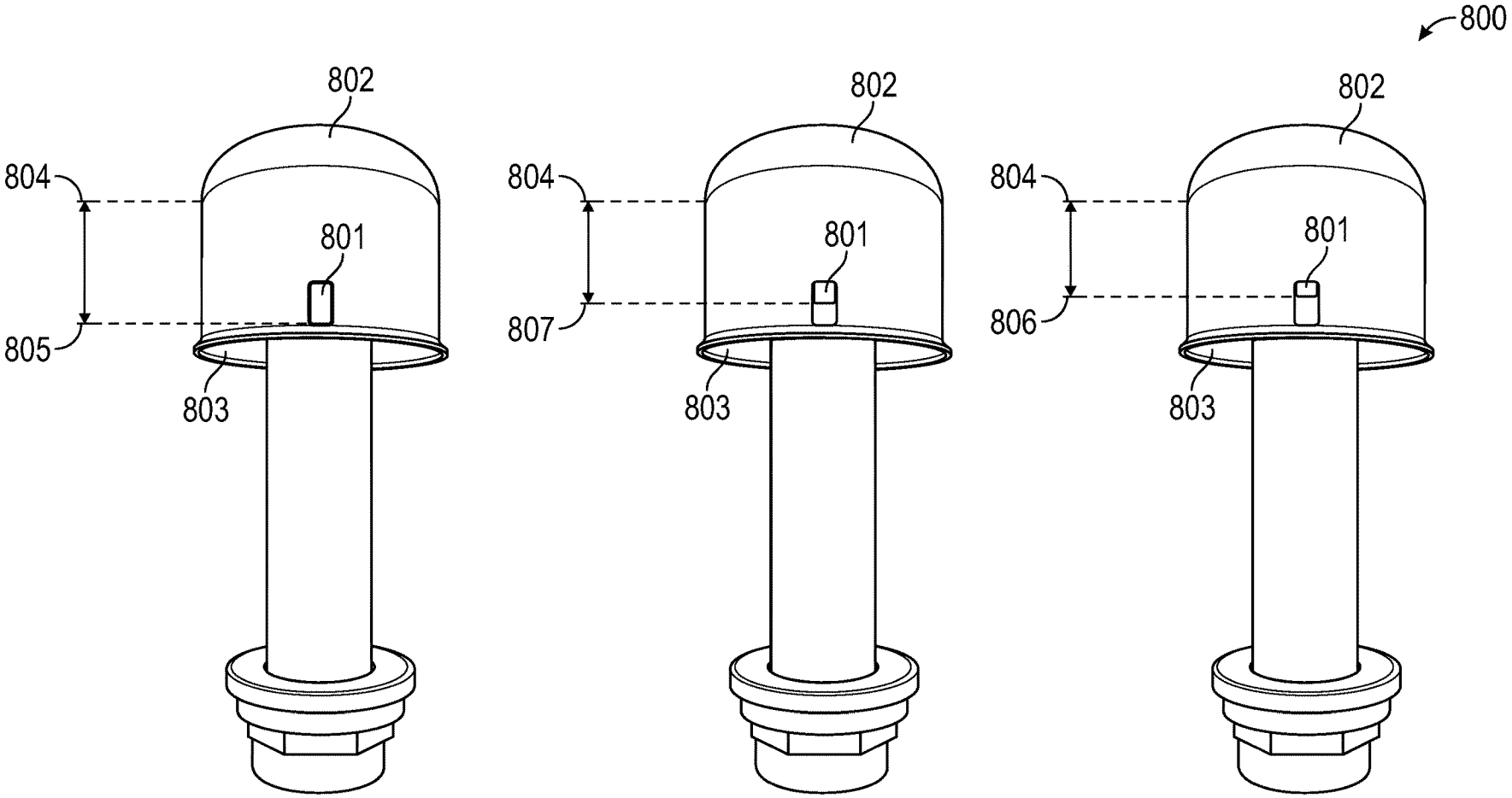
FIG. 8A, FIG. 8B, and FIG. 8C show a flush valve assembly, according to an embodiment.

FIG. 8A, FIG. 8B, and FIG. 8C, show another siphon flush valve 800, according to an embodiment. Siphon flush valve 800 include a gate 801. Gate 801 may selectively opened or closed to adjust a gate opening located in head 802. Gate 801 may be a sliding gate. Gate 801 may allow a siphon to be selectively ended. That is, gate 801 may control the end of a siphon effect and thus control the end of a flush. Gate 801 may allow for a siphon to end at a particular point, thus tailoring a flush discharge volume. Gate 801 may allow more or less fluid than a normal flush to be discharged from the tank to the toilet bowl. That is, an amount of fluid allowed to discharge from a toilet tank may be dependent on the height of gate 801. Other heights of gate 801 may be provided. More than one gate 801 may be provided.

As previously described, when air enters siphon flush valve inlet 803, a siphon effect is ended and a flush cycle is ended. With gate 801 in a fully closed position of FIG. 8A, a siphon may break or end when the tank water level falls to a first ending water level 805. This may allow air to enter the valve through siphon flush valve inlet 803. This may allow for a maximum or full discharge of a fluid from the tank to the toilet bowl. A position of FIG. 8A may discharge a total volume between first ending water level 805 and a beginning water level 804.

With gate 801 in a fully open position of FIG. 8C, a siphon may break or end when the tank water level falls to a second ending water level 806 prior to first ending water level 805. Since gate opening of FIG. 8C is located at a higher vertical location than siphon flush valve inlet 803 and since gate opening is open, air will enter siphon flush valve 800 prior to first ending water level 805. With gate 801 open and gate opening exposed, air may be permitted to enter a siphon prior to a condition of FIG. 8A. This may result in the ending of a siphon effect sooner than a condition of FIG. 8A. A position of FIG. 8C may discharge a total volume between second ending water level 806 and the beginning water level 804. This total volume may be a minimum discharge allowed by the toilet. This total volume may be smaller than the volume discharged in a condition of FIG. 8A.

With gate 801 in an intermediate position, as shown in FIG. 8B, a siphon may break or end when the tank water level falls to a third ending water level 807 prior to first ending water level 805. Third ending water level 807 may be between second ending water level 806 and first ending water level 805. Since a gate opening is located at a higher vertical location than siphon flush valve inlet 803 and since gate opening is open, air will enter siphon flush valve 800 prior to first ending water level 805. With gate 801 open and gate opening exposed, air may be permitted to enter a siphon prior to a condition of FIG. 8A. This may result in the ending of a siphon effect sooner than a condition of FIG. 8A. Since gate 801 is open such that a gate opening is lower than a condition of FIG. 8C, a siphon effect may be ended later than a condition of FIG. 8C. A position of FIG. 8B may discharge a total volume between third ending water level 807 and the beginning water level 804. This total volume may be an intermediate discharge allowed by the toilet. This total volume may be smaller than the volume discharged in a condition of FIG. 8A and larger than the volume discharged in a condition of FIG. 8C. A position of gate 801 may be selectively positioned at any number of positions between a condition of FIG. 8A and a condition of FIG. 8C such that a selective volume of fluid may be discharged from a tank to a toilet bowl. Gate 801 may be selectively controlled by an actuator or controller, similar to the actuators and controllers described herein.

Gate 801 may comprise a door or sliding member extending over a gate opening. Gate 801 may be slidably coupled to head 802 of siphon flush valve 800. Gate 801 may alternatively by hinged, pivotally coupled or rotatably coupled, or other moveable coupling, to head 802 to allow for selective opening and closing of a gate opening. A gate opening may be a hole or aperture in head 802. A gate opening may be a sliding gate that slides to adjust the opening for more or less discharge volume. Alternative coupling types may be used, for example, detents, clips, ratchets, etc. A gate opening and gate 801 may be substantially rectangular in shape, although other shapes may be provided. Although a single gate opening and gate 801 are depicted, more than one may be provided. Gate openings and gates 801 may be symmetrically or asymmetrically disposed around a circumference of head 802.

A spray initiator may be a sprayer, spray initiator, and/or a nozzle. A spray initiator may be secured within a head opening via adhesion, friction fit, press fit, threads, glue, overmolding, screw threads, bayonet threads, or other types. A spray initiator may be formed as a unitary, single body or may be formed from a plurality of parts coupled together. An initiator may have a substantially cylindrical outer surface with a bore therethrough. An initiator may be tubular in shape. An initiator may have a flange configured to secure to a lower surface of a head.

A toilet may be a gravity-fed toilet, a tankless toilet, a wall hung toilet, a one-piece toilet, a two-piece toilet, a pressurized toilet, a commercial toilet, a residential toilet, a hands free toilet, a sensor actuated toilet, a manual toilet, etc. An actuator may be manual, electrical, hydraulic, pneumatic, mechanical, or hydro-mechanical. An actuator may be associated with a battery. A supply valve may be associated with an infrared sensor (IR sensor), logic circuit and/or printed circuit board (PCB). During operation, an IR sensor may be activated by a user (e.g. the IR sensor senses when the user moves from a sensor path). An IR sensor may communicate this to a controller which sends a signal to the solenoid to open thus admitting water through a siphon flush valve fluid supply line. A solenoid may be programmed to open for a predetermined time or to be opened and closed, respectively, based on signals from a controller.

A tubular core may have a choke point at a transition from a first substantially tubular section to a tapered section. A choke point may be configured to improve flow dynamics and efficiencies. A choke point may improve flow dynamics and efficiencies, for example, due to a divergence of a tubular core bore. A divergence of a core bore may be caused by the diameter of bore tapering inwardly and subsequently tapering outwardly. A divergence of a bore may be where a bore extends (or alternatively tapers inwardly) from a first diameter at a top of first substantially tubular section to a choke point and subsequently tapers outwardly during a tapered section to an inner diameter of a second substantially tubular section. A divergence of a bore may increase the velocity or speed of a fluid flowing through a siphon flush valve as compared to a straight bore. An increased velocity of a fluid flow may increase the rate of discharge of fluid from a toilet tank to a toilet bowl, thus enhancing efficiency and performance of a toilet. A core may be substantially tubular. A first substantially tubular section, a tapered section, and a second substantially tubular section may be coupled or integrally formed.

A tapered section may taper outwardly from a first diameter $D_1$ of a first substantially tubular section to a second diameter $D_2$ of a second substantially tubular section. A second diameter $D_2$ may be larger than first diameter $D_1$. A tapered section may taper both internally (e.g. the bore of a tapered section may taper outward) and externally (e.g. the outer surface of a tapered section may taper outward). A core may include a flange extending outwardly from an outer surface of a tubular core. Flange may be located at a lower end of a tapered section and/or at an upper end of a second substantially tubular section. Flange may align a siphon flush valve with a tank opening and maintain a siphon flush valve therein. Enhanced flow, as previously described, may be achieved from a first substantially tubular section and a tapered section due to the expanding bore diameter. An enhanced flow may be divergent flow where under full flow conditions, flow transitions from a choke point gradually diverging outward. This may create flow separation thus increasing a flow velocity through a choke point. A change in diameter may benefit or aid in establishing siphon flow during an initial or transient phase (e.g. during initiation of a siphon flow in a siphon flush valve). Various configurations may be contemplated in accordance with the invention to increase flow velocity and volume. This may also reduce the amount of time and/or flow needed to establish a siphon flow.

A siphon flush valve inlet and a fluid flow path may be substantially annular. A flow path may be defined between an inner surface of a head and an outer surface of a tubular core. A flow path may be defined from a structure of a head and a tubular core, embodiments of which are described herein. A siphon flush valve may have an internal cavity defined by a tubular bore and a flow path. A siphon flush valve may have a longitudinal axis L. A head, initiator, and/or core may be aligned along the longitudinal axis L. A head and core may be concentric about the longitudinal axis L. Where head and core are not circular in cross-section, head and core may still be aligned with center points along the longitudinal axis. A head may be wider and/or have a larger diameter than a tubular core such that siphon flush valve inlet and/or a flow path is defined therebetween. An area defined by a space between a siphon flush valve inlet and an upper portion of a core may be greater than or equal to the area defined by a space between a head apex and a weir. A space between a head apex and a weir may be greater than or equal to the area defined by a top of bore. An initiator may be located such that a spray pattern emitted from initiator contacts the bore at or lower than a weir.

A starting surrounding water level may be at a higher vertical position than a siphon flush valve inlet. A starting water level may be higher than a siphon flush valve inlet to ensure no air exists at a siphon flush valve inlet (e.g. a water seal is present) and to ensure a siphon may be initiated when a flush cycle is started. A starting water level may be at or near the top of a weir. A water level lower than the top of a weir may require a greater pressure differential to initiate siphon flow. A water level higher than the top of a weir may provide for water to spill over and provide a "run on" condition. Surrounding water in a toilet tank which at a starting water level may be water at atmospheric pressure. In an initial condition, surrounding fluid, such as water, may be supplied through a siphon flush valve fluid supply line. Water may be pressurized water and may be admitted through a solenoid valve that is opened with an actuator. Water may exit a siphon flush valve fluid supply line and discharge into a bore through a spray initiator. Water may exit initiator in a cone pattern. Cone pattern may be substantially cone-shaped, such as, a full cone, a hollow cone, or a square cone shape. A tapered portion of a bore of an initiator may be configured for water to exit an initiator in cone pattern. That is, since a tapered portion of a bore has a conical shape, water which exits this portion may also take on a conical shape. Discharge of water in a cone pattern into a tubular bore may create a negative pressure differential. A pressure differential may be such that the pressure within a siphon flush valve is lower than the pressure in a toilet tank. A starting surrounding water level in a toilet tank may have an initial condition at atmospheric pressure. Water that flows out of an initiator may be at a higher pressure than the atmospheric pressure of starting surrounding water level. This may create a reduced pressure at a weir and flush valve inlet. A reduced pressure within siphon flush valve induces a siphon effect, pulling water from starting surrounding water into a siphon flush valve inlet, through a flow path, over a weir, into a tubular bore and out a siphon flush valve outlet.

Once a siphon effect has been initiated, the pressurized water from siphon flush valve fluid supply line may be stopped. Pressurized water may be stopped by closing a valve. So long as no air is provided to an interior of a siphon flush valve, water may continue to empty from a toilet tank to a toilet bowl for flushing of a toilet. As water approaches an ending water level, the water level may no longer completely cover a siphon flush valve inlet. Accordingly, air may be permitted to enter siphon flush valve inlet and become entrained with flow of water through the siphon flush valve. With air entering the siphon flush valve inlet, the siphon effect through siphon flush valve is stopped and a flush is stopped.

A height of starting surrounding water level and a height of ending surrounding water level may be selected such that the volume therebetween effectively flushes a toilet. A height between starting surrounding water level and ending surrounding water level may be optimized for a predetermined discharge volume. A fill valve may be controlled to refill a toilet tank to the starting water level. A siphon flush valve inlet may be placed at a height corresponding to a desired ending water level. A system thus may be configured for a fixed flush volume discharge.

Various parameters may be customized or altered in the operation of a toilet and/or siphon flush valve. Such parameters include dimensions and parameters (e.g. diameters, lengths, shape, orientation, etc.) of a siphon flush valve, height of the weir, fluid pressure from the main plumbing source, fluid pressure in a siphon flush valve fluid supply line, dimensions and parameters (e.g. diameters, lengths, shape, orientation, etc.) of the initiator, size and orientation of a siphon flush valve inlet, duration of the initiator discharging fluid, activation time of an actuator, solenoid, and/or initiator, etc. In an exemplary embodiment, a siphon flush valve with the previously described parameters, may have the following parameters to achieve a siphon flush effect to discharge fluid from a toilet tank to a toilet bowl. A solenoid may be open for about 2.5 seconds at about 40 psi and above to initiate siphon flow. Refilling or resealing of a toilet bowl may be achieved by increasing a duration ("ON" time) to dispense additional water for this purpose. Refilling or resealing may be an amount of water needed to refill a toilet bowl to a level to provide a water seal to prevent sewer gasses from traveling through a trapway (not depicted) and up through a bowl. An actuator, solenoid, and initiator may be dual purpose in function; one, to initiate siphon action, and two, to refill a water seal in a toilet bowl after a flush cycle, if the timing is configured to allow this added function. A divergent flow pattern may be used to form a seal between a nozzle and a valve core inside diameter perimeter. Another seal may be created by a starting water level which is at or near a weir height. As water is flowing through a sprayer contacting a core inner perimeter wall and flowing downward, it creates a negative pressure or vacuum to cause atmospheric pressure acting on a free surface to push cistern water up and over the weir and thusly establishing gravity siphon flow. Other flow patterns are contemplated. For example, if, a straight flow column were large enough to contact a core inner perimeter wall, it may generate siphon flow.

A head may have an outer surface having a substantially cylindrical or tubular shape. An outer surface may curve radially outward at a lower end. A lower end may create a concave surface in an outer surface. A lower end may be radiused or profiled to improve flow dynamics and efficiencies. A radiused or profiled lower end may improve flow dynamics by reducing energy losses. An outer surface may extend longitudinally upward from a lower end to an upper end. At an upper end, an outer surface may curve at a curved portion upward from an outer end to an apex and then downward toward a head opening. A head opening may have a substantially cylindrical shape. In a lateral view, a head may appear "donut" shaped.

A siphon flush valve may taper outwardly at the top. A full round feature may form an effective siphon with sprayer technology alone. An outward taper profile, under dynamic flow conditions, at an initial or transient flow stage (air and water) may follow the profile shape, first spilling over at the weir, secondly following the taper downward and thirdly, following vertically downward. As flow, for example, the flow velocity, increases, the flow will separate from the boundary wall at the taper to the vertically downward transition resulting in convergent flow stream toward a center of the valve. As the valve is of substantially circular design in cross-section, the resulting annular flow will meet in the bore of a siphon flush valve and effectuate a seal to allow a pressure differential to form as water flows downward through a bore of a siphon flush valve (e.g. through the down leg portion), thus aiding a siphon effect to develop in the siphon flush valve. A previously described action, combined with a previously mentioned initiator, may be configured for a siphon to form and transition to full siphon (no air) more quickly than a full round weir feature. Other profile shapes may be provided for improving efficiencies.

An upper portion of a tubular core may have an outwardly and downwardly extending shape. An upper portion may include a wall which extends and/or curves from weir outward and downward to a lower surface. A lower surface may be curved or turned inward toward the core from the wall. A weir may be a profiled or radiused throat to provide a flow path with improved flow dynamics and efficiencies. An upper portion may form a gap between an exterior surface of a core and a wall of an upper portion. A gap may be substantially annular. A weir may align with a center of a curved portion of a head. In this manner, when assembled, a head and an upper portion of a core may be substantially concentric. A relationship between a head and an upper portion may provide a siphon flush valve inlet and a flow path for fluid, such as water, to flow from an exterior of a siphon flush valve through a tubular bore. A siphon flush valve inlet and flow path may be annular. An outward curve of a lower surface of a core and an outward curve of a lower end of a head may provide an enlarged siphon flush valve inlet. This may improve flow dynamics and efficiencies.

In some embodiments, a head and tubular core may have shapes other than cylindrical, for instance ovular. A width of a head and a core may be smaller than a length of the head and the core. An oval or elliptical shape of a siphon flush valve may allow siphon flush valve to be accommodated in more toilet tanks as toilet tanks are generally more wide than deep. Although a circular and elliptical siphon flush valve are described, a siphon flush valve may be other shapes.

Although siphon flush valves of the present disclosure are depicted and described as substantially concentrically arranged siphon flush valves, other shapes and arrangements are possible. A substantially concentric siphon flush valve may allow for uniform flow from the tank into a siphon flush valve. Uniform flow may improve the efficiency and rate of flow in a siphon flush valve. Other contemplated shapes and arrangements (e.g. non-concentric arrangements) may also exhibit uniform flow from the tank into a siphon flush valve.

A toilet system may include a control assembly. A control assembly may be coupled to a toilet tank. A control assembly may be coupled to an exterior of the toilet tank. A control assembly may be coupled to an interior of the toilet tank within a water proof compartment or container. A control assembly may include one or more of a sensor, a battery, wiring, or a printed circuit board controller (controller). A sensor may be an infrared sensor (IR sensor) for detecting the presence and/or absence of a user at toilet. A control assembly may be associated with solenoid valve. Alternatively, a sensor may be omitted and a system may be actuated by manual flush handle or button actuator. A solenoid valve is controllable between an open position and a closed position. In an open position, a valve may admit fluid from a first siphon flush valve supply line to a second siphon flush valve supply line. A second siphon flush valve supply line may be the same as a siphon flush valve fluid supply line previously described. A second siphon flush valve supply line may supply water to an initiator. In a closed position, a valve may prevent flow between a second siphon flush valve supply line and a first siphon flush valve supply line. Alternatively, a solenoid may be replaced with a metering valve or hydro-mechanical valve. Hydro-mechanical and/or metering valves may use line pressure and/or springs to temporarily open the valve. A printed circuit board may send and receive signals from sensor to and from a solenoid. A battery may be a battery pack and may supply power to the various electric components. A control assembly may be mounted on a mounting board.

A tee may allow a water source for an initiator to be tapped prior to a fill valve. A pressure for an initiator may be determined by a building infrastructure, typically between about 20 psi and about 120 psi. A lower pressure may equate to a lower spray volume and lower pressure generation in a siphon flush valve, thus resulting in a lower efficiency siphon flush valve. Initiators of the present disclose may form a pattern, annular in form, from the center of an initiator head diverging toward and making contact with the bore of the core.

In some embodiments, a present system may comprise a vacuum breaker, which may be required to allow a flush valve to be code compliant. A vacuum breaker may be positioned upstream (prior to) a spray initiator.

Divergent spray angles ranging from about 50 degrees to about 120 degrees may be provided. A spray pattern may be solid or hollow in form and may be cone, square, pyramid, or oval, etc. in shape. Initiators may be singular or plurality part construction. An initiator may be fixed permanently or made for ease of removal for maintenance. An initiator may be fixed by overmolding, glue, interference fit, screw, or bayonet thread. In some embodiments, a connection between an initiator and a siphon flush valve head may be sealed, e.g., leak-free.

Siphon flush valves of the present disclosure allow for a flapperless flush system. Siphon flush valves of the present disclose allow for a system which does not leak due to worn, chemically degraded, damaged, etc. flapper seals. Siphon flush valves of the present disclosure allow for a flush valve with no moving parts, reducing the likelihood of damage, failure, and/or need for repair. A concentric design of the head with respect to the core allows for higher flow throughput in a compact structure.

Siphon flush valves of the present disclosure may be combined with a bidet and/or a tankless toilet. Siphon flush valves of the present disclosure may work with one-piece and two-piece toilets having a water tank reservoir. For a one-piece toilet, a siphon flush valve may have a base fixation type that may differ from the two-piece toilet (e.g. the threaded spud with nut). Siphon flush valves of the present disclose may be provided to a toilet having a remote tank or cistern. For example, a tank or cistern hidden in a wall. In this example, additional water conduits may be needed.

Some siphon valve embodiments include the following.

In a first embodiment, disclosed is a siphon valve, the siphon valve comprising a tubular core; a head coupled to a top of the core, the head having a head opening; an initiator coupled to the head opening; a siphon valve inlet; and a siphon valve outlet, wherein the initiator is configured to induce a siphon flow of a fluid, through the siphon valve inlet, and exiting through the siphon valve outlet.

In a second embodiment, disclosed is a siphon valve of the first embodiment, wherein the head is a substantially cylindrical cap located around or about the core. In a third embodiment, disclosed is the siphon valve of the first and second embodiments, wherein the head opening is located towards a center of the substantially cylindrical cap and wherein the initiator extends downward from the opening into the core.

In a fourth embodiment, disclosed is a siphon valve of any of the preceding embodiments, wherein the core further comprises a weir located at an upper surface of the core. In a fifth embodiment, disclosed is the siphon valve of any of the preceding embodiments, wherein the core comprises a first substantially tubular section, a tapered section, and a second substantially tubular section, wherein an upper portion of the first substantially tubular section curves outward at the weir and extends longitudinally downward from the weir.

In a sixth embodiment, disclosed is a siphon valve of any of the preceding embodiments, comprising a flow path defined between an inner surface of the head and an outer surface of the core. In a seventh embodiment, disclosed is a siphon valve of any of the preceding embodiments, wherein the initiator comprises a bore having a substantially constant diameter and tapered outwardly.

In an eighth embodiment, disclosed is a siphon valve of any of the preceding embodiments, wherein the siphon valve inlet is located at a lower end of the head and the siphon valve outlet is located at a lower end of the core. In a ninth embodiment, disclosed is a siphon valve of any of the preceding embodiments, further comprising an internal cavity, wherein the siphon valve inlet is configured such that the internal cavity has a first pressure when at a tank starting water level and a second pressure when at a tank ending water level.

In a tenth embodiment, disclosed is a siphon valve of any of the preceding embodiments, wherein the initiator is a spray initiator. In an eleventh embodiment, disclosed is a siphon valve of any of the preceding embodiments, wherein the spray initiator is a pressurized spray initiator. In a twelfth embodiment, disclosed is a siphon valve of any of the preceding embodiments, wherein the siphon valve inlet is positioned with a first configuration below a tank starting water level and a second configuration above a tank ending water level.

In a thirteenth embodiment, disclosed is a siphon valve of any of the preceding embodiments, wherein the head and the core are substantially longitudinally axially aligned. In a fourteenth embodiment, disclosed is a siphon valve of any of the preceding embodiments, wherein the siphon valve is flapperless. In a fifteenth embodiment, disclosed is a siphon valve of any of the preceding embodiments, wherein the siphon valve inlet is located circumferentially around the core.

In a sixteenth embodiment, disclosed is a siphon valve of any of the preceding embodiments, wherein the head is dome-shaped and wherein the head is wider than the core to define the siphon valve inlet. In a seventeenth embodiment, disclosed is a siphon valve of any of the preceding embodiments, wherein the initiator is configured to discharge a pressurized fluid to the core in a cone-shaped spray. In an eighteenth embodiment, disclosed is a siphon valve of any of the preceding embodiments, wherein the initiator is configured to create a pressure differential between a bore of the core and a toilet tank.

In a nineteenth embodiment, disclosed is a siphon valve of any of the preceding embodiments, wherein the head is located substantially concentrically around the core such that the siphon valve inlet and a flow path are formed between the head and the core. In a twentieth embodiment, disclosed is a siphon valve of any of the preceding embodiments, wherein the siphon valve comprises no moving parts.

In a twenty-first embodiment, disclosed is a siphonic valve system, the siphonic valve system comprising a siphon valve, the siphon valve having a core coupled to a toilet tank opening, a head having a head opening and attached at a top of the core, and an initiator coupled to the head opening, a siphon valve fluid supply line coupled to the initiator; a fluid supply valve coupled to the siphon valve fluid supply line;

and an actuator configured to open the fluid supply valve to initiate a flow of pressurized fluid in the siphon valve fluid supply line, wherein the initiator is configured to supply the flow of pressurized fluid to the core to initiate a siphon flow of a fluid in a toilet tank, through the siphon valve, and into a toilet bowl.

In a twenty-second embodiment, disclosed is a siphonic valve system of the twenty-first embodiment, wherein the initiator is configured to discharge the flow of pressurized fluid to the core in a cone-shaped spray. In a twenty-third embodiment, disclosed is a siphonic valve system of the twenty-first or twenty-second embodiments, wherein the initiator is configured to create a pressure differential between a bore of the core and the toilet tank.

In a twenty-fourth embodiment, disclosed is a siphonic valve system of any of embodiments 21 to 23, comprising a flow path from a siphon valve inlet and a siphon valve outlet and wherein the siphon flow flows through the flow path. In a twenty-fifth embodiment, disclosed is a siphonic valve system of any of embodiments 21 to 24, wherein the flow path extends from the siphon valve inlet, through a space between the core and the head, over a weir on the core, though a bore of the core, and to the siphon valve outlet.

In a twenty-sixth embodiment, disclosed is a siphonic valve system of any of embodiments 21 to 25, wherein the head is located substantially concentrically around the core such that a siphon valve inlet and a flow path are formed between the head and the core.

In a twenty-seventh embodiment, disclosed is a siphonic valve system of any of embodiments 21 to 26, wherein the core further comprises a weir and a down leg portion and wherein the initiator extends into the down leg portion. In a twenty-eighth embodiment, disclosed is a siphonic valve system of any of embodiments 21 to 27, wherein the siphon valve is configured to empty the fluid in the toilet tank from a starting water level adjacent the weir to an ending water level adjacent a siphon valve inlet.

In a twenty-ninth embodiment, disclosed is a siphonic valve system of any of embodiments 21 to 28, wherein the siphon valve is flapperless. In a thirtieth embodiment, disclosed is a siphonic valve system of any of embodiments 21 to 29, wherein the siphon valve has no moving parts. In a thirty-first embodiment, disclosed is a siphonic valve system of any of embodiments 21 to 30, wherein the fluid supply valve is a solenoid valve.

In a thirty-second embodiment, disclosed is a siphonic valve system of any of embodiments 21 to 31, wherein the actuator is configured to close the fluid supply valve to terminate the flow of pressurized fluid in the siphon valve fluid supply line.

In a thirty-third embodiment, disclosed is a siphonic valve comprising: a valve body; a valve bore within the valve body; and a spray initiator in fluid communication with the valve bore, wherein the spray initiator is configured to discharge a pressurized fluid in contact with an entire perimeter of the valve bore to create a fluid seal within the valve bore to initiate a siphon flow within the valve.

In a thirty-fourth embodiment, disclosed is a siphonic valve of the thirty-third embodiment, wherein the spray initiator is configured to create a negative pressure differential in the valve bore to initiate the siphon flow. In a thirty-fifth embodiment, disclosed is a siphonic valve of embodiments 33 or 34, wherein the spray initiator is configured to discharge the pressurized fluid in a full cone-shaped spray, hollow cone-shaped spray, a square cone-shaped spray or a pyramid-shaped spray.

Some method embodiments of the disclosure include the following.

In a first embodiment, a method for siphonic flow through a siphon flush valve in a toilet, the method comprising: supplying a pressurized fluid to an initiator in a siphon flush valve; discharging the pressurized fluid into the siphon flush valve to create a pressure differential inside the siphon flush valve; initiating a siphon flow of a fluid in a toilet tank; flowing the fluid in the toilet tank from a siphon flush valve inlet to a siphon flush valve outlet; and terminating the siphon flow of the fluid from the toilet tank when an ending fluid level in the toilet tank is reached.

In a second embodiment, the method of the first embodiment, wherein supplying the pressurized fluid to the initiator comprises opening a solenoid valve with an actuator to initiate a flow of the pressurized fluid through a siphon flush valve fluid supply line.

In a third embodiment, the method according to the first or second embodiments, wherein discharging the pressurized fluid into the siphon flush valve comprises discharging the pressurized fluid in a full cone-shaped spray, hollow cone-shaped spray, square cone-shaped spray, or pyramid-shaped spray.

In a fourth embodiment, the method according to any of the preceding embodiments, wherein initiating the siphon flow of the fluid in the toilet tank comprises causing the fluid in the toilet tank to rise up to the siphon flush valve inlet, spill over a weir in the siphon flush valve, and flow through a down leg portion of the siphon flush valve to the siphon flush valve outlet.

In a fifth embodiment, the method of any of the preceding embodiments, wherein terminating the siphon flow comprises introducing air into the siphon flow.

In a sixth embodiment, the method of any of the preceding method embodiments, further comprising terminating the pressurized fluid through the initiator at a predetermined time after the siphon flow is initiated.

In a seventh embodiment, the method of any of the preceding embodiments, further comprising discharging the fluid in the toilet tank from the siphon flush valve outlet to a toilet bowl.

In an eighth embodiment, the method of any of the preceding embodiments, further comprising a starting fluid level at a height of a weir in the siphon flush valve and an ending fluid level at a height of the siphon flush valve inlet.

In a ninth method embodiment, disclosed is a method for initiating fluid flow in a flush valve of a toilet, the method comprising: discharging a pressurized fluid from a spray initiator in a flush valve; contacting an entire perimeter of a bore of the flush valve with the pressurized fluid; creating a fluid seal within the bore; creating a negative pressure differential in the bore; initiating a siphon flow in the flush valve; and discharging fluid from a toilet tank to a toilet bowl with the siphon flow.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" or "fluid communication" means for example configured for liquid or gas flow there through. The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular and "tube-like" means generally shaped like a tube, but not necessarily perfectly cylindrical.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

All U.S. patent applications, published patent applications and patents referred to herein are hereby incorporated by reference.

The invention claimed is:

1. A siphon valve assembly, the assembly comprising
a tubular core having an inner surface and an outer surface;
a head coupled to and surrounding an upper end of the tubular core;
a fluid spray initiator coupled to the head;
a fill valve;
a first pressurized fluid supply line;
a second pressurized fluid supply line; and
a fluid supply valve,
wherein
a lower end of the head defines a siphon valve inlet,
a lower end of the tubular core defines a siphon valve outlet,
the upper end of the tubular core comprises a weir,
the tubular core is configured to be positioned in a toilet tank and couple to a toilet tank outlet,
the spray initiator is located towards a center of the head and extends downward through an opening in the head into the tubular core,
the first pressurized fluid supply line is coupled to the fill valve and the fluid supply valve,
the second pressurized fluid supply line is coupled to the fluid supply valve and the fluid spray initiator,
the fluid supply valve is configured to be opened by an actuator, to cause the pressurized fluid to flow through the first pressurized fluid supply line, through the fluid supply valve, and through the second pressurized fluid supply line to the fluid spray initiator, and
the fluid spray initiator is configured to discharge the pressurized fluid into the tubular core to induce a siphon flow of a surrounding fluid in a toilet tank through the siphon valve inlet, over the weir, out the siphon valve outlet, and into a toilet bowl, and
wherein the fluid spray initiator is configured to spray the pressurized fluid on an entire perimeter of the tubular core inner surface to form a fluid seal, thereby creating negative pressure in the tubular core and initiating the siphon flow.

2. The siphon valve assembly of claim 1, wherein the head comprises a plurality of splines extending from an inner surface thereof, the splines configured to locate and hold the head in place on the tubular core upper end.

3. The siphon valve assembly of claim 1, wherein the tubular core comprises a first tubular section, a tapered section, and a second tubular section, wherein an upper portion of the first tubular section curves outward at the weir and extends longitudinally downward from the weir.

4. The siphon valve assembly of claim 1, configured so that siphon flow of the surrounding fluid continues until a surrounding fluid level drops to the lower end of the head and air enters the siphon valve inlet, thereby breaking the siphon flow.

5. The siphon valve assembly of claim 1, wherein the head and the tubular core are longitudinally axially aligned.

6. The siphon valve assembly of claim 1, wherein the siphon valve inlet is located circumferentially around the tubular core.

7. The siphon valve assembly of claim 1, wherein the initiator is configured to discharge the pressurized fluid into the tubular core at a spray angle of from 45 degrees to 132 degrees.

8. The siphon valve assembly of claim 1, wherein the spray initiator comprises a downward, outwardly tapered bore portion.

9. The siphon valve assembly of claim 1, wherein the assembly comprises no moving parts.

10. The siphon valve assembly of claim 1, wherein the actuator is an electronic actuator in electronic communication with the fluid supply valve.

11. The siphon valve assembly of claim 1, wherein the fluid spray initiator is a pigtail initiator.

12. The siphon valve assembly of claim 1, wherein the fluid supply valve is a solenoid valve.

13. The siphon valve assembly of claim 1, wherein the actuator is a mechanical actuator.

14. The siphon valve assembly of claim 1, comprising an actuator configured to open the fluid supply valve to initiate flow of the pressurized fluid into the tubular core and to close the fluid supply valve after a predetermined time interval to stop the flow of the pressurized fluid into the tubular core.

15. The siphonic valve assembly of claim 1, wherein the fluid supply valve is a metering valve or a hydro-mechanical valve.

16. A toilet tank comprising the siphonic valve assembly of claim 1.

17. A toilet assembly comprising a bowl and a water tank comprising the siphonic valve assembly of claim 1.

18. The siphon valve assembly of claim 1, wherein the spray initiator is configured to discharge fluid into the tubular core in a spray shaped to form the fluid seal with the tubular core inner surface.

19. The siphon valve assembly of claim 18, wherein the spray initiator is configured to discharge fluid in a square cone-shaped spray or a pyramid-shaped spray.

20. The siphonic valve assembly of claim 18, wherein the spray initiator is configured to discharge fluid in a full cone-shaped spray, hollow cone-shaped spray, square cone-shaped spray, or a pyramid-shaped spray.

* * * * *